United States Patent [19]

Stemmler et al.

[11] Patent Number: 5,005,816

[45] Date of Patent: Apr. 9, 1991

[54] INTERFOLDER DEVICE WITH DYNAMIC PRESSURE SECTION CONNECTED AT THE OUTLET SIDE OF THE FOLDING ROLLERS

[75] Inventors: Kurt Stemmler, Neuwied; Ludwig Weckop, Dusseldorf; Egon Marth, Neuwied, all of Fed. Rep. of Germany

[73] Assignee: Winkler & Dunnebier Maschinenfabrik und Eisengiesserei KG, Neuwied, Fed. Rep. of Germany

[21] Appl. No.: 352,272

[22] Filed: May 16, 1989

[30] Foreign Application Priority Data

Jun. 13, 1988 [DE] Fed. Rep. of Germany ..... 3820032

[51] Int. Cl.[5] ..... B41L 1/32

[52] U.S. Cl. ..... 270/39; 198/689.1; 198/534

[58] Field of Search ..... 270/39, 32, 40, 30, 270/31; 198/493, 689.1, 534, 532

[56] References Cited

U.S. PATENT DOCUMENTS

| | | | |
|---|---|---|---|
| 2,449,663 | 9/1948 | Marcalus | 270/39 |
| 2,467,977 | 4/1949 | Jones | 270/39 |
| 3,529,713 | 9/1970 | Poupin | 198/689.1 |
| 3,607,583 | 9/1971 | Geschwender | 270/39 |
| 4,304,508 | 12/1981 | Wolf | 198/689.1 |

FOREIGN PATENT DOCUMENTS

| | | | |
|---|---|---|---|
| 10494 | 12/1932 | Australia | 270/39 |
| 154030 | 8/1938 | Fed. Rep. of Germany | 270/39 |

*Primary Examiner*—Edward K. Look
*Assistant Examiner*—Therese M. Newholm
*Attorney, Agent, or Firm*—Collard, Roe & Galgano

[57] ABSTRACT

An interfolder device for folding sheet material in a zig-zag manner which uses a pair of counter rotating rollers for receiving the sheet material and an elongated guide track disposed below the counter rotating rollers for receiving, supporting and conveying the sheet material as it is folded on the guide track. There is also provided a dynamic pressure means consisting of a vacuum that is coupled to the guide track by means of perforations formed in the guide track in order to apply a brake to the sheet material as it is supported and conveyed along the track during its folding process.

8 Claims, 2 Drawing Sheets

INTERFOLDER DEVICE WITH DYNAMIC PRESSURE SECTION CONNECTED AT THE OUTLET SIDE OF THE FOLDING ROLLERS

INTRODUCTION

This invention relates to a material interfolder. More specifically, this invention relates to an interfolder with counter rotating folding rollers having a dynamic pressure section connected thereto at the outlet side in order to generate a dynamic pressure by means of the pile to be drawn off consisting of folded cloth.

BRIEF DESCRIPTION OF THE PRIOR ART

Interfolders are commonly used to produce interfolded zig-zag shaped cloth like face towels, hand towels or toilet paper made from paper, tissue or similar materials. The material to be processed is fed to the counter rotating folding rollers in the form of widths, cut to individual section lengths, and then interfolded in zig-zag manner. The cloth, having been interfolded, leaves the folding rollers in the form of an endless pile, and is transported, for example, to a repository stand, via a dynamic pressure section. The dynamic pressure section is intended to provide a dynamic pressure of the pile spring on the folding rollers, a requirement for the optimum functioning of the folding rollers. In this regard, the dynamic pressure should be adjusted within certain limits in order to adjust to an optimum value. On the other hand, however, once the adjustment has been determined, the dynamic pressure should remain largely constant, independent of changing characteristics of material or ambient conditions.

It has already been proposed that the dynamic pressure section can be designed as an upwardly directed inclined plane of variable slope. This solution suffers from the drawback that, in this configuration, the operation height of the repository stand would also have to be varied. It is currently standard pratice to connect a dynamic pressure section to the outlet side of the folding cylinders of an interfolder, the section being configured as a belt conveyer section. The belt speed can be varied with respect to the operating speed of the folding cylinders. Its drive is derived from the main gear of the machine and provided via an adjustable gear. The cloth folded by the folding cylinders moves up in the form of an endless pile onto the belt, and is conveyed away by the speed of the belt. The dynamic pressure hereby resulting is, for the given strength of the material, independent of the amount of cloth fed to the belts per unit of time, and of the belt conveyor speed. Experience has unfortunately shown that the strength of the widths of material being processed is subjected to considerable fluctuation. This results in dynamic pressure variations which partly exceed permissible rates.

The principal drawback, consequently, of this kind of dynamic pressure generation is that, in order to maintain a passably constant dynamic pressure, trained personnel must constantly monitor and correct the belt speed in order to adjust the changing strength of the material used.

BRIEF DESCRIPTION OF THE INVENTION

It is therefore an object of the present invention to provide a dynamic pressure section which maintains a one-time adjusted value of the dynamic pressue, independent of the changing characteristics of the widths of material being processed.

Accordingly, the invention provides a dynamic pressure section as a guide which utilizes a multiplicity of perforations which are connected by air conduit to a vacuum source. An advantage of this solution is that variations in the characteristics of the material, in particular in the strength of the processed widths of materials, no longer affect the level of dynamic pressure. The constant monitoring and setting adjustments normally required with dynamic pressure sections equipped with conveyor belts, are not required when the dynamic pressure section of the invention is used.

Other objects and features of the present invention will become apparent from the following detailed description considered in connection with the accompanying drawing which discloses the embodiments of the invention. It is to be understood that the drawing is designed for the purpose of illustration only and not as a definition of the limits of the invention.

BRIEF DESCRIPTION OF THE DRAWINGS

In the drawings, wherein similar reference characters denote similar elements throughout the several views.

Figure 1:
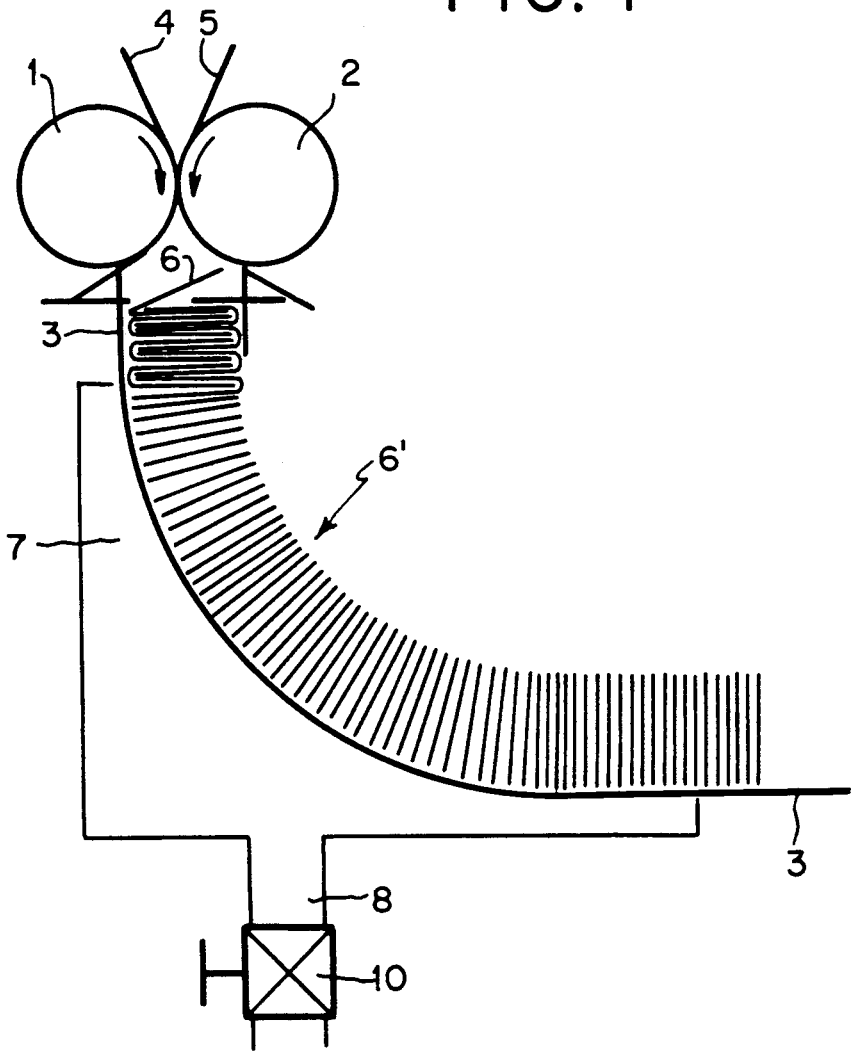
FIG. 1: is a lateral view of an interfolder, with folding rollers and including the dynamic pressure section of the invention connected at the outlet side of the folding rollers; and, FIG. 2: is a top view of FIG. 1.
Figure 2:
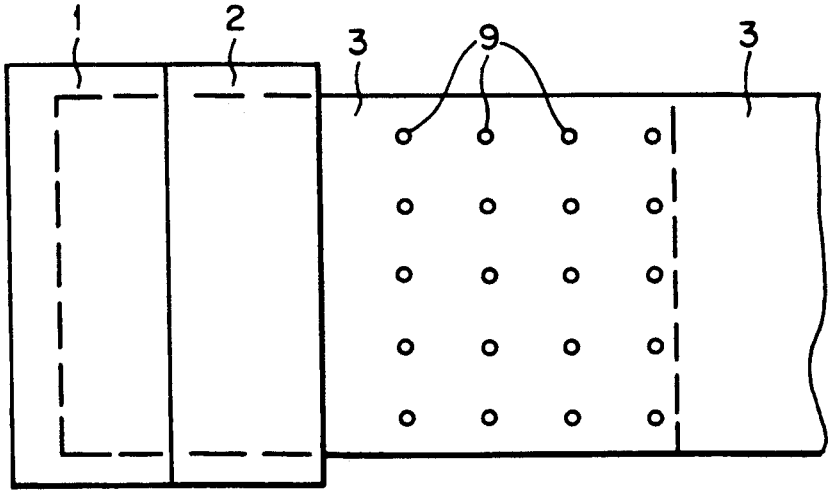

The interfolder consists basically of two folding rollers 1 and 2, shown here only in outline from. The rollers are disposed above a guide 3. The material to be processed is fed to folding rollers 1 and 2 in the form of widths of material 4 and 5. The finished cloth 6, interfolded in zig-zag manner, leaves the folding rollers in the form of an endless pile 6', which is advanced along guide 3. Guide 3 consists of sheet metal having a smooth surface which is somewhat wider than the widest material to be processed. It effects the connection between folding rollers 1 and 2 and a repository stand, or a finishing machine (not shown).

The first part of guide 3 extends vertically downward, and merely serves as a track. The piece which connects thereto, includes the 90° cuvature and a horizontal portion connecting thereto and constitutes the dynamic pressure section which is of particular interest in this invention. The essential element of this dynamic pressure section is to brake cloth 6 in such a way that folding cylinders 1 and 2 operate at an optimum dynamic pressure. The concept behind the invention is to achieve this optimum dynamic pressure by configuring the dynamic pressure section as a suction brake. For this purpose, a suction box 7 has been arranged beneath the part of guide 3 which functions as the dynamic pressure section. The suction box is connected by an air conduit to a vacuum source, (not shown), via a line 8. The vacuum provided in suction box 7 and acting through holes 9 on guide 3 and on the underside of pile 6' formed from cloth 6, draws this pile in on guide 3. The bearing pressure of pile 6' increases as does the friction of the pile on guide 3. The suction force and, consequently, the braking effect, can be adjusted for through the design of the number and size of holes 9, as well as by the level of the vacuum in suction box 7. The number and size of holes 9 are determined during the earlier design phases. The fine tuning of the braking effect or the dynamic pressure required during operation is achieved exclusively through adjustment of the vacuum. For this purpose, an adjustment valve 10 has been disposed in line 8. Valve 10 is configured as a simple butterfly valve or, in another embodiment of the invention, as a regulating valve which automatically maintains the vacuum in suction box 7 at a predetermined level.

Figure 3:
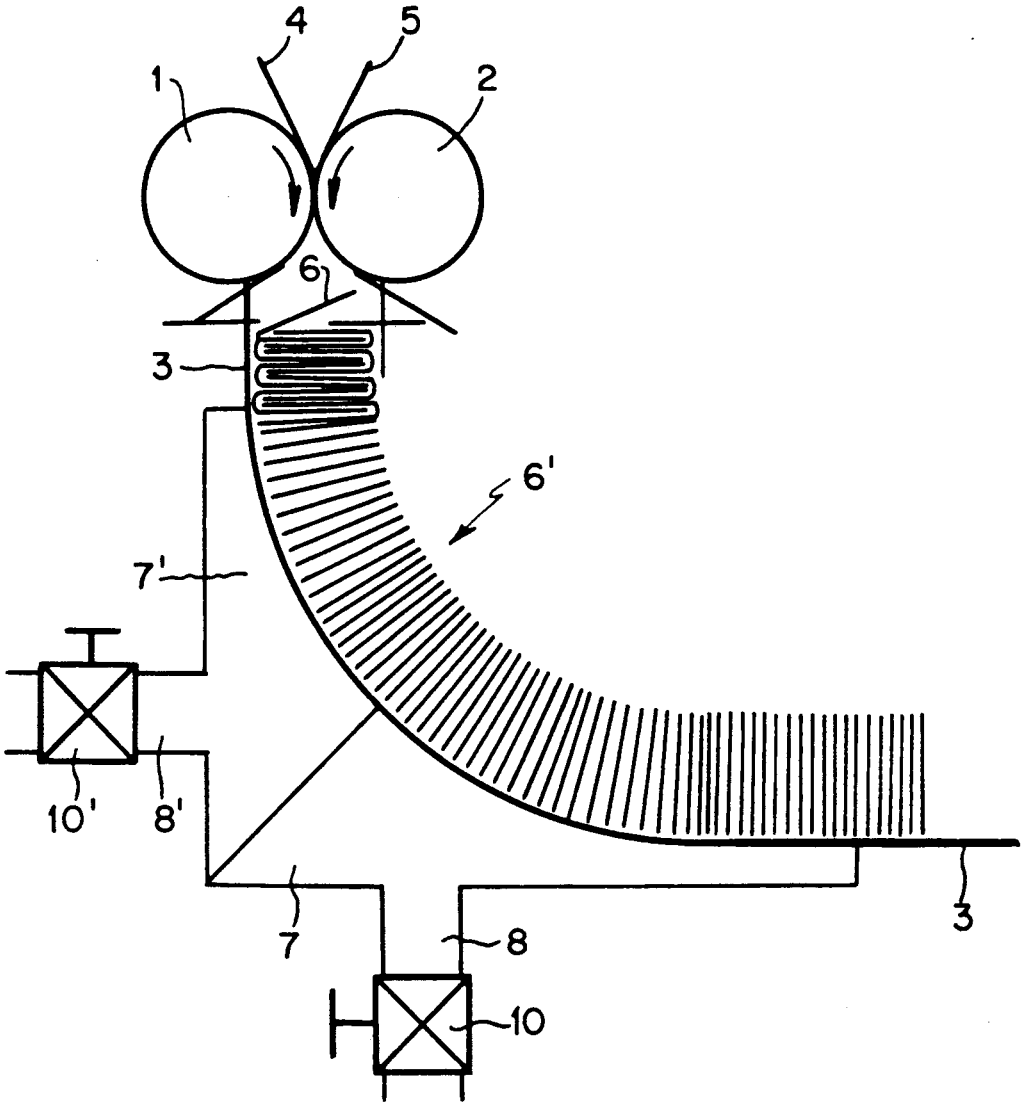
FIG. 3: is a lateral view of another embodiment of FIG. 1, showing a plurality of vacuum sections.

Valve 10 can be arranged to maintain the vacuum in suction box or chamber 7 at a constant level. Moreover, suction chamber 7 can be split up into several chambers or channels as shown in FIG. 3, in which each chamber can have a different vacuum from the adjacent chamber in order to fine tune the guide track as the sheet material is folded.

A further, horizontally extending part of guide 3 connects to the dynamic pressure section but is of no interest to the invention since, as has already been mentioned, it merely constitutes the transition of the interfolder with its dynamic pressure section to a repository stand or a finishing machine.

while only a single embodiment has been shown and described it is obvious that many changes and modifications may be made thereunto without departing from the spirit and scope of the invention.

What is claimed is:

1. An interfolder device for folding sheet material in a zig-zag manner comprising;

a pair of counter rotating rollers for receiving the sheet material;

an elongated guide track disposed adjacent to said rollers for receiving, supporting and conveying the sheet material as it is folded; and, dynamic pressure means coupled to said guide track for providing a vacuum brake to the sheet material as it is conveyed along said guide track.

2. The interfolder device as recited in claim 1 wherein said dynamic pressure means includes a suction chamber for connection to a vacuum source and communicative with the guide track, and a plurality of perforations disposed on the surface of said guide track and communicative with said suction chamber.

3. The interfolder device as recited in claim 2 wherein the perforations are holes disposed in spaced apart relationship along the surface of said guide track that is in contact with said sheet material.

4. The interfolder device as recited in claim 3 additionally comprising an adjustment valve coupled between the vacuum source and said suction chamber for regulating the vaccum in said suction chamber.

5. The interfolder device as recited in claim 4, wherein said adjustment valve maintains the vaccum in said suction chamber at a constant vaccum.

6. The interfolder device as recited in claim 5 wherein said suction chamber has a plurality of sections, and means for establishing varying vaccum conditions in each of said sections.

7. The interfolder as recited in claim 1 wherein said elongated guide track including a 90° curvature along a first portion thereof, and a horizontal section forming a second portion thereof.

8. A method of folding sheet material in a zig-zag manner comprising the steps of;

receiving from a pair of counter rotating rollers the sheet material onto an elongated guide track;

applying a vacuum to the guide track in contact with the sheet material for braking the sheet material as it is supported and conveyed along the guide track.

* * * * *